US005085618A

United States Patent [19]

Mochizuki

[11] Patent Number: 5,085,618

[45] Date of Patent: Feb. 4, 1992

[54] STEERING DEVICE FOR USE IN A TOY CAR

[75] Inventor: Takashi Mochizuki, Shimizu, Japan

[73] Assignee: Kabushiki Kaisha Tamiya Mokei, Shizuoka, Japan

[21] Appl. No.: 608,024

[22] Filed: Nov. 2, 1990

Related U.S. Application Data

[63] Continuation of Ser. No. 317,718, Mar. 2, 1989, abandoned.

[30] Foreign Application Priority Data

Mar. 9, 1988 [JP] Japan ..... 63-30418

[51] Int. Cl.[5] ..... A63H 17/36

[52] U.S. Cl. ..... 464/185; 446/460

[58] Field of Search ..... 74/470; 446/454, 456, 446/437, 460, 468; 464/51, 77, 100, 101, 180, 185

[56] References Cited

U.S. PATENT DOCUMENTS 2,484,321 10/1949 Stubau ..... 464/77
2,783,627 3/1957 Rossmann ..... 464/77
3,635,304 1/1972 Hills ..... 446/468 X
4,171,592 10/1979 Saitoh ..... 446/456
4,573,723 3/1986 Morita et al. ..... 464/77 X
4,623,322 11/1986 Melchior ..... 464/51 X
4,810,229 3/1989 Shoji ..... 446/460 X

FOREIGN PATENT DOCUMENTS 60-192893 12/1985 Japan .

*Primary Examiner*—Joseph J. Hail, III
*Assistant Examiner*—William G. Battista, Jr.
*Attorney, Agent, or Firm*—Finnegan, Henderson, Farabow, Garrett and Dunner

[57] ABSTRACT

A steering device for use in a toy car includes an output member having a pair of deformable arms and coupled to a servo, and an input member having side surfaces to be in contact with the free ends of the arms. When the great amount of reaction force from the wheel is applied through the input member to the arm of the output member, this force will be absorbed by the arm due to its elastic deformation so that the damage of the servo is nothing.

11 Claims, 2 Drawing Sheets

STEERING DEVICE FOR USE IN A TOY CAR

This application is a continuation of application Ser. No. 07/317,718 filed Mar. 2, 1989, now abandoned.

BACKGROUND OF THE INVENTION

1. Field of the Invention

The present invention relates to a steering device adapted for use in a toy car, such as radio controlled cars.

2. Description of the Prior Art

A radio controlled toy car comprises a transmitter which is to be operated by a modeler through a steering stick and a forward-reverse stick, a receiver which receives signals of radio waves from the transmitter, and servos which are operated by signals from the receiver, but translated into mechanical movements. These mechanical movements are put out from a servo horn to the model unit to be controlled. The model car having these elements can be controlled at will by manipulating a stick of the transmitter quickly or slowly, to full range of throw or half way, the movement of the servo horn is hooked up to be transmitted to, for instance, front wheel/steering of the car.

An example of a steering device for use in a toy car according to a prior art is shown in FIG. 3. The device includes cylindrical members 2, 3 having a pair of arms and disposed on the chassis 1. Both the cylindrical members 2, 3 are fixed to the chassis 1 by means of a screw 4. When the cylindrical members 2, 3 are to be fixed to the chassis 1, a spring 6 is interposed between the head 5 of the screw 4 and the upper surface of the cylindrical member 2 and the biasing force of the spring 6 is applied to the surfaces of both cylindrical members 2, 3 which are in abutment against each other. Said surfaces in abutment of the cylindrical members 2, 3 are tapered surfaces cut away in two opposite directions so that when the tapered surfaces of both the cylindrical members 2, 3 are mated completely together, both the cylindrical members will provide a rod having no clearance at the joint portions of their outer circumferential surfaces.

One of the cylindrical member 2 will be coupled to output shaft 8 of the servo 7, and the other cylindrical member 3 will be coupled to a link (not shown) to be connected to wheels.

According to the embodiment as shown according to the prior art, when the servo 7, having received a signal from the transmitter, causes the output shaft 8 to be rotated, the cylindrical member 2 will also be rotated through an angle corresponding to the rotation of said output shaft. However, since the spring 6 forcibly pushes the cylindrical member 2 against the cylindrical member 3, the cylindrical member 3 is caused to rotate together with the cylindrical member 2 to provide a necessary steering angle to a wheel.

If a wheel hits a rock or drops in a crack on a road so that the steering of said wheel is uncontrollable; and when the output shaft 8 of the servo 7 is rotated under such a condition, the cylindrical member 2 alone at the side of the servo 7 will be rotated against the biasing force of the spring 6. Because the cylindrical member 3 can not be rotated, the tapered surfaces will slip against each other, and accordingly, the servo 7 can not create a reaction force more than a predetermined value.

As is clearly seen from FIG. 3, according to the prior art, the sliding resistance between the cylindrical member 2 and 3 is adjusted by biasing the spring 6 against the top surface of one of the cylindrical members. Since the biasing force of spring 6 is variable due to inherent variation in the manufacture thereof, or the biasing force may be varied depending on how much the screw 4 is tightened, it is difficult to keep constant the sliding resistance between the cylindrical members 2, 3 for every product.

Furthermore, the requirement of a spring 6 itself causes a increase in the number of parts and makes the management of the parts more complicated.

The present invention has therefore as an object subject to solve or eliminate the problems of the prior art as above explained.

In order to solve the problems as above mentioned, there is provided a steering device for use in a toy car including an output member having integrally formed therewith a cylindrical part adapted to be coupled to the output shaft of a servo, and a pair of arms so formed as to surround the cylindrical part, and an input member having a bore placed on the cylindrical part, and a portion connected to the link for a wheel, characterized in that the side edge portions of the input member will be in abutment with the free ends of the arm of said output member.

The output torque from the servo is transmitted from the arms at the output member to the input member and provides a necessary rotary angle to the input member. However, when a wheel is in such a condition as not being able to rotate, the output torque from the servo will elastically deform said arms for the torque to be absorbed by the arms and will not forcibly move the wheel. In other words, no reaction force from a wheel more than necessary, will be transmitted to the output shaft of a servo. Accordingly, the servo will not be damaged; and since excessive torque is absorbed by the arms, a spring, as used in the prior art, will not be necessary. Furthermore since the elastic force of the arms is determined by the configuration and the material of the arms, variation of said elastic force from product to product, quite infrequent.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
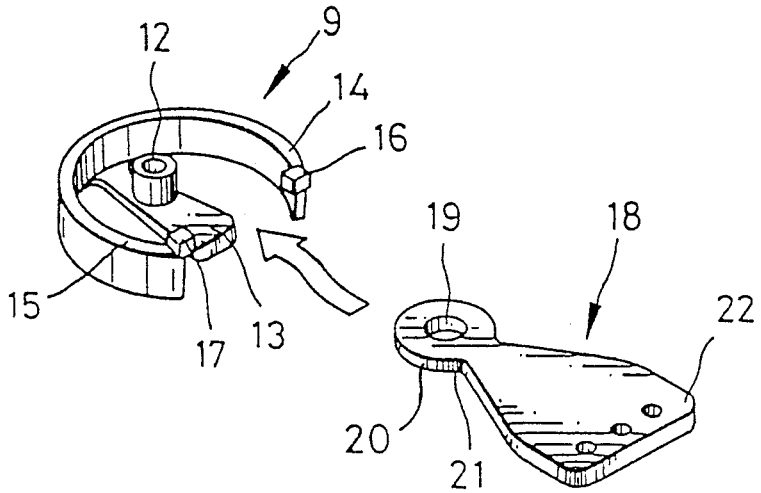
FIG. 1 is a perspective exploded drawing of an embodiment of the present invention.
Figure 2:
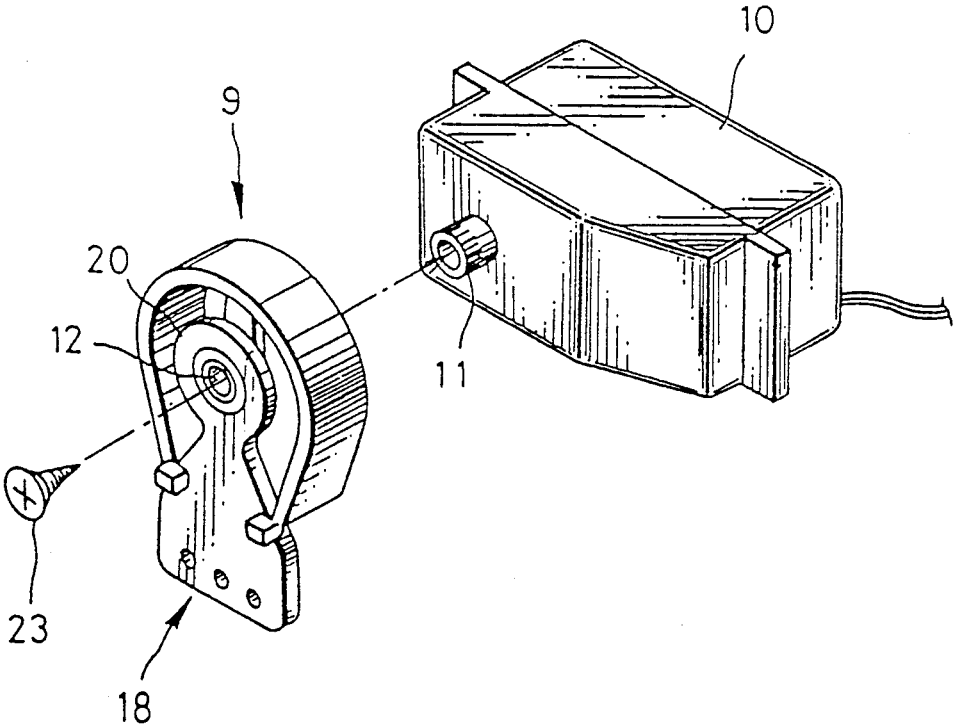
FIG. 2 is a perspective assembly drawing of the embodiment of the present invention.
Figure 3:
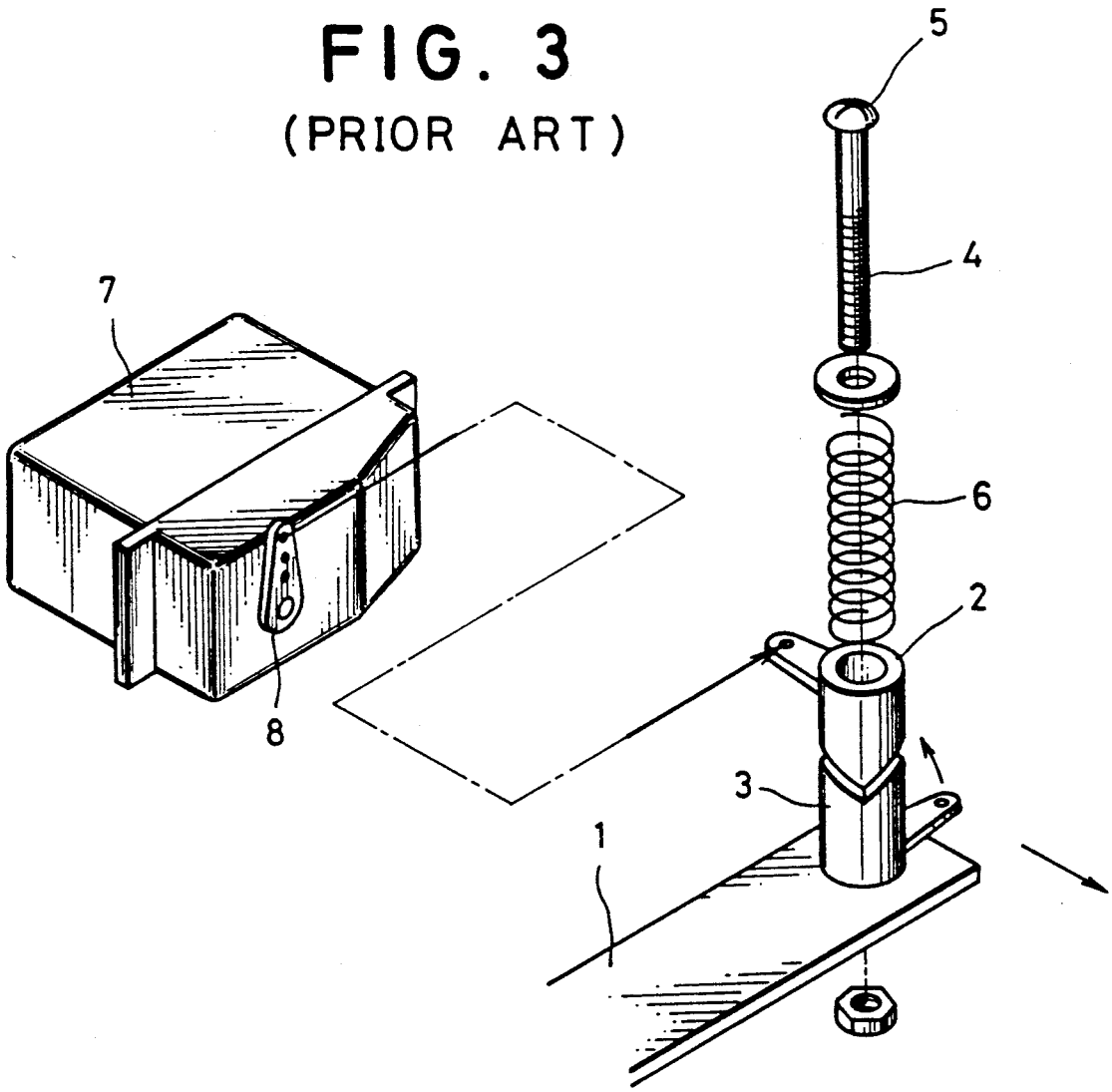
FIG. 3 (PRIOR ART)
FIG. 3 is the perspective view showing the prior art.

Output member 9 has a base 13 having at the center a cylindrical part 12 adapted to be coupled to the output shaft 11 of a servo 10. A pair of arcuate arms 14 and 15 are provided in a manner to extend from one end of the base 13 to surround the cylindrical part 12. The free ends of the respective arms 14, 15 are spaced from each other; and pieces 16, 17 having one end extending toward one another are provided at the upper surface of the free ends. The height of the arms 14, 15 is lower than that of the cylindrical part 12. The output member 9 is made of plastic material, such as polyacetal or polyamide.

The input member 18, preferably made of the same material as that of the output member 9, has a head portion 20 having a bore 19 adapted to be placed on the cylindrical part 12, a neck portion 21 narrower than the head portion 20 and an attachment portion 22 of a flared configuration. The attachment portion 22 is connected to a link (not shown) which serves to change the direction of a wheel. The width of the head portion 20 of the input member 18 is narrower than the distance between the free ends of the arms 14, 15. The thickness of the head portion 20 is so sized that when the bore 19 is placed on the cylindrical part 12, the upper surface of the head portion 20 is flush with those of the arms 14, 15 or slightly lower than the height of the cylindrical part 12.

In order to combine both members 9 and 18, the head portion 20 is put in between the free ends of the arms 14, 15 slightly slanting and the bore 19 is placed on the cylindrical part 12. When the lower surface of the head portion 20 is seated on the upper surface of the base 13, the upper surface of the attachment portion 22 is in abutment with the pieces 16, 17 so that the input member 18 may be prevented from disengagement with the arms 14, 15. A screw 23 having a head of larger diameter than that of the bore 19 of the head portion 20 of the input member 18 is screwed through the cylindrical part into the output shaft 11 of a servo, whereby the output member 9 may be secured to the servo 10 and the input member 18 may be slidably attached to the output member 9. The width of the attachment portion 22 of a flared configuration of the input member 18 is slightly wider than the distance between the arms 14, 15 of the output member 9 when the input member is assembled to the input member 18 so as to avoid looseness.

Rotation of the output shaft 11 causing, will cause rotation of the input member 9 secured to the output shaft 11 and one of the arms 14, 15 to push the input member 18 and rotate it.

On the other hand, reaction force from a wheel at a time when steering is not possible such as that caused when a wheel hits against a certain obstacle, will elastically deform one of the arms 14 or 15 for absorbing the force; and this reaction force will not be directly transmitted to the servo 10. Accordingly no excessive reaction will not be applied to the servo 10, which will not thereby be damaged.

Both members 9 and 18 may be easily attached to each other by passing the head 20 through the space defined between the free ends of the arms 14, 15 and placing the bore 19 on the cylindrical part to be coupled to the shaft of a servo. Pieces 16, 17 prevent the input member 18 from coming off the output member 9, so that assembly of both members 9, 18 may be further firm. Furthermore, elastic force of the arms 14, 15 may be controlled depending on their configuration; and material and variation of elastic force from products to product can be reduced. Since this assembly may be coupled directly to the shaft of the servo, the entire construction may be made very compact.

As many apparently widely different embodiments of the present invention can be made without departing from the spirit and scope thereof, it is to be understood that the invention is not limited to the specific embodiments thereof except as defined in the appended claims.

What is claimed is:

1. A steering device for a toy car adapted to be coupled to an output shaft of a servo, said device comprising:

a first member having a central portion including an axially extending hollow-cylindrical portion for attachment to the servo output shaft and having a pair of resilient arm portions with free ends, said pair of resilient arm portions being attached to the central portion at a location intermediate the free ends and extending from opposite sides of the attached location with the free ends spaced a predetermined distance from one another; and a second member having a head portion rotatably mounted to the axially extending hollow cylindrical portion and having an extended portion longitudinally extending from the head portion between the free ends of the resilient pair of arms of the first member;

said first member being fixedly connected to and rotatable with the output shaft as a servo output member, the second member having means for attachment to a steering link of a toy car, and engaging the pair of arms to rotate with said first member as a steering link input member.

2. The steering device of claim 1 wherein the head portion of the second member has a bore slidably disposed on the cylindrical portion of the first member.

3. The steering device of claim 2 wherein the pair of arms further comprise a retaining piece disposed adjacent the free end of each arm of the first member to extend inwardly toward one another to keep axially the second member in the mounted position relative the first member.

4. The steering device of claim 1 wherein both free ends of the pair of arms physically engage the extended portion of the second member.

5. The steering device of claim 1 wherein the pair of arms are spaced from the central portion of the first member.

6. The steering device of claim 1 wherein the pair of arms is an arcuate member having axially inner and outer extending surfaces defining the width of the arms and terminating at upper and lower radially extending edge surfaces; and said device further comprises a retaining member mounted on the upper edge surface and extending inwardly beyond the inner axially extending surface for retaining the extended portion of the second member within the upper and lower edge surfaces of the first member.

7. The steering device of claim 4 wherein the first member is plastic.

8. A steering device for a toy car adapted to be coupled to an output shaft of a servo, said device comprising:

a first member having a central portion including an axially extending hollow cylindrical portion for connection to the servo output shaft and having a pair of resilient arms internally attached to and extending from opposite sides of the central portion with free ends spaced a predetermined distance from one another; and a second member having a head portion with a bore slidably disposed on the cylindrical portion of the first member and having an extended portion longitudinally spaced from the head portion extending between the free ends of the resilient pair of arms;

said first member being fixedly connected to and rotatable with the output shaft as a servo output member, the second member having means for attachment to a steering link of a toy car and engaging the pair of arms to rotate with said first member as a steering link input member;

said pair of arms include a retaining piece disposed adjacent the free end of each arm of the first member to extend inwardly toward one another to keep axially the second member in the mounted position relative the first member.

9. A steering device for a toy car adapted to be coupled to an output shaft of a servo, said device comprising:

a first member having a central portion including an axially extending hollow cylindrical portion for connection to the servo output shaft and having a pair of resilient arms integrally attached to and extending from opposite sides of the central portion with free ends spaced a predetermined distance from one another, the pair of arms being an arcuate member having axially inner and outer extending surfaces defining the width of the arms and terminating at upper and lower radially extending edge surfaces; and said device further comprising a retaining member mounted on the upper edge surface and extending inwardly beyond the inner axially extending surface for retaining the extended portion of the second member within the upper and lower edge surfaces of the first member; and a second member having a head portion with a bore slidably disposed on the cylindrical portion of the first member and having an extended portion longitudinally spaced from the head portion extending between the free ends of the resilient pair of arms;

said first member being fixedly connected to and rotatable with the output shaft as a servo output member, the second member having means for attachment to a steering link of a toy car and engaging the pair of arms to rotate with said first member.

10. The steering device of claim 9 wherein the central portion of the first member, comprises a base plate fastened to the lower edge surface of the arcuate member intermediate the free ends of the arms, and a cylindrical member mounted on the base plate and extending axially toward the upper edge surface, and wherein the head portion of the second member includes a bore into which the cylindrical portion of the first member slidably extends.

11. The steering device of claim 10 wherein the head portion of the second member is configured to fit between the free ends of the arm, and the extended portion is in engagement with the free ends of the arms with the bore of the head mounted on the cylindrical portion of the first member.

* * * * *

UNITED STATES PATENT AND TRADEMARK OFFICE

CERTIFICATE OF CORRECTION

PATENT NO. : 5,085,618

DATED : February 4, 1992

INVENTOR(S) : TAKASHI MOCHIZUKI

It is certified that error appears in the above-identified patent and that said Letters Patent is hereby corrected as shown below:

Claim 7, column 4, line 48, change "claim 4" to --claim 1--.

Claim 8, column 4, line 56, change "internally" to --integrally--.

Signed and Sealed this

Fifteenth Day of June, 1993

*Attest:*

Michael K. Kirk

MICHAEL K. KIRK

*Attesting Officer*

*Acting Commissioner of Patents and Trademarks*